US006138823A

United States Patent [19]

Focke et al.

[11] Patent Number: 6,138,823

[45] **Date of Patent: *Oct. 31, 2000**

[54] HINGE-LID PACKET FOR CIGARETTES

[75] Inventors: Heinz Focke; Harald Gosebruch, both of Verden, Germany

[73] Assignee: Focke & Co. (GmbH & Co.), Verden, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/948,398

[22] Filed: Oct. 10, 1997

[30] Foreign Application Priority Data

Oct. 21, 1996 [DE] Germany ..... 196 43 411

[51] Int. Cl.[7] ..... A24F 15/00

[52] U.S. Cl. ..... 206/259; 206/268; 206/273; 206/459.1

[58] Field of Search ..... 206/259, 264, 206/273, 268, 831, 271, 274, 459.1

[56] References Cited

U.S. PATENT DOCUMENTS

| | | | |
|---|---|---|---|
| 2,296,556 | 9/1942 | Junkin . | |
| 2,617,578 | 11/1952 | Fischer | 206/831 |
| 2,886,234 | 5/1959 | Toensmeier . | |
| 2,929,542 | 3/1960 | O'Gorman . | |
| 3,018,878 | 1/1962 | Watkins | 206/831 |
| 3,199,769 | 8/1965 | Hillman, II et al. | 206/831 |
| 3,205,603 | 9/1965 | Brumley | 206/459.5 |
| 3,207,411 | 9/1965 | Farquhar | 206/459.5 |
| 4,216,898 | 8/1980 | Davies | 206/259 |
| 4,308,679 | 1/1982 | Ray, III et al. | 40/312 |
| 4,838,424 | 6/1989 | Petzelt | 206/459 |
| 4,948,038 | 8/1990 | Moeller | 229/146 |
| 5,009,518 | 4/1991 | Faltynek | 383/106 |
| 5,105,969 | 4/1992 | Lamas | 220/404 |
| 5,137,148 | 8/1992 | Evers . | |
| 5,160,024 | 11/1992 | Evers . | |

FOREIGN PATENT DOCUMENTS

| | | |
|---|---|---|
| 739729 | 10/1969 | Belgium . |
| 1712297 | 7/1955 | Germany . |
| 1996454 | 11/1968 | Germany . |
| 8711574 | 12/1987 | Germany . |
| 9109659 | 11/1991 | Germany . |
| 9315457 | 3/1994 | Germany . |

*Primary Examiner*—Bryon P. Gehman
*Assistant Examiner*—Nhan T. Lam
*Attorney, Agent, or Firm*—Sughrue, Mion, Zinn, Macpeak & Seas, PLLC

[57] ABSTRACT

Conventional cigarette packets with flap-tops are often referred to as hinge-lid packets. They consist of a packet portion 12, a lid 13 connected to the packet portion 12 by a hinge, and a collar 35 disposed in the packet portion 12. In order to create new appeal for hinge-lid packets, openings 52, 53 are formed with the packet portion 12 and the lid 13 so that imprinting may be displayed. The openings or recesses 52, 53 are closed on the side pointing towards the packet contents, namely the block of cigarettes 45. Regions 50, 51 of the collar front wall 36 and lid inner flap 43, respectively, serve as carriers for the imprinting so that it may be displayed through the openings 52 and 53.

6 Claims, 4 Drawing Sheets

HINGE-LID PACKET FOR CIGARETTES

SPECIFICATION

The invention relates to a hinge-lid packet for cigarettes with a packet portion for receiving a block of cigarettes, a lid hinged to a rear wall of the packet portion and a collar connected to the packet portion and consisting of collar front wall and collar side walls.

Hinge-lid packets are a widespread type of packaging for cigarettes. The hinge-lid packet consists of a packet portion and a lid disposed on a rear wall of the packet portion so as to be able to be swung back. A collar is arranged on the packet portion. The collar has a collar front wall and collar side walls. The collar protrudes in an upper section from the packet portion. The free portion of the collar is surrounded by the lid when the hinge-lid packet is in the closed position. The collar can be both part of a one-piece blank for manufacturing the hinge-lid packet and manufactured from a separate blank. The packet contents, namely a group of cigarettes, is surrounded by an inner wrapping of tinfoil or the like and thus forms a block of cigarettes.

The problem underlying the invention is to improve a hinge-lid packet of the design described above so that additional functions, such as conveying additional information, can be realised.

To solve this problem, the hinge-lid packet according to the invention is characterised in that recesses are arranged in the region of the packet portion and/or of the lid and are closed on the side pointing towards the block of cigarettes. The recesses are associated with walls of the packet portion and/or of the lid. The recesses are preferably closed by regions of the packet portion and/or lid and/or collar. In the region of the recesses, the regions of the packet portion and/or lid and/or collar carry an imprint. This can be advertising information, a coupon or a two-dimensional graphic design.

According to an advantageous development of the invention, the recess(es) is closed towards the outside by a covering which may be detached from the packet portion or lid. When the covering has been detached by the consumer, the information lying under the covering is revealed.

Figure 1:
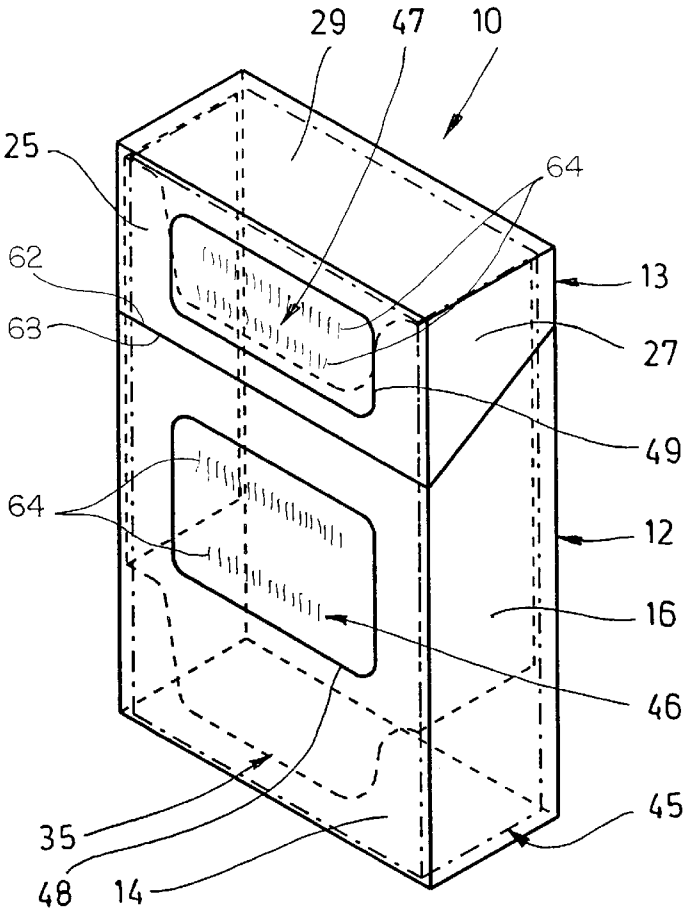
Figure 2:
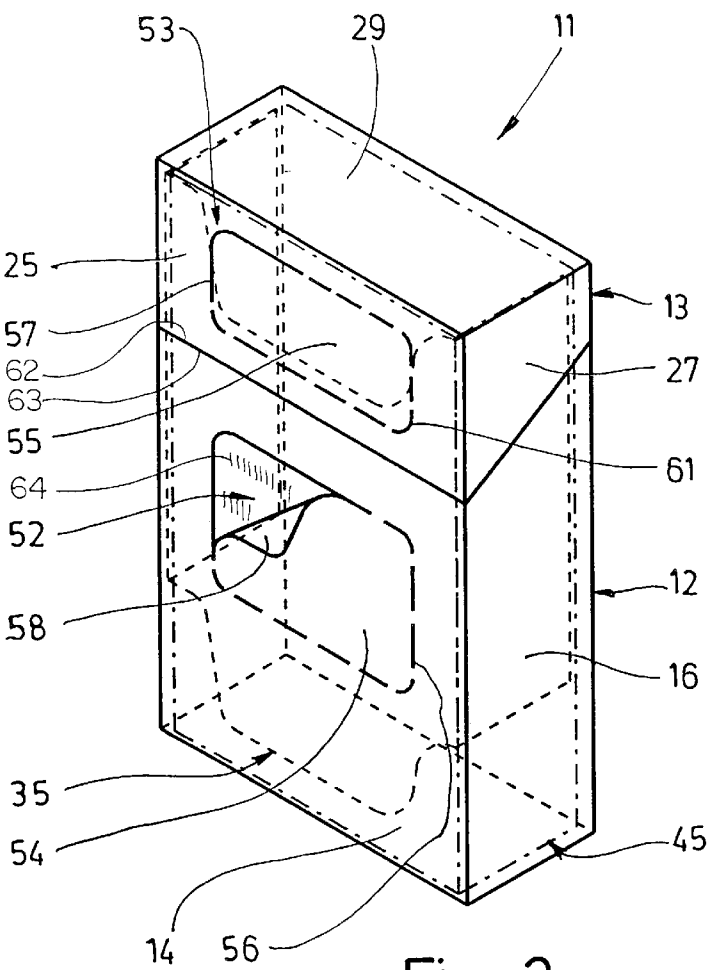
Figure 3:
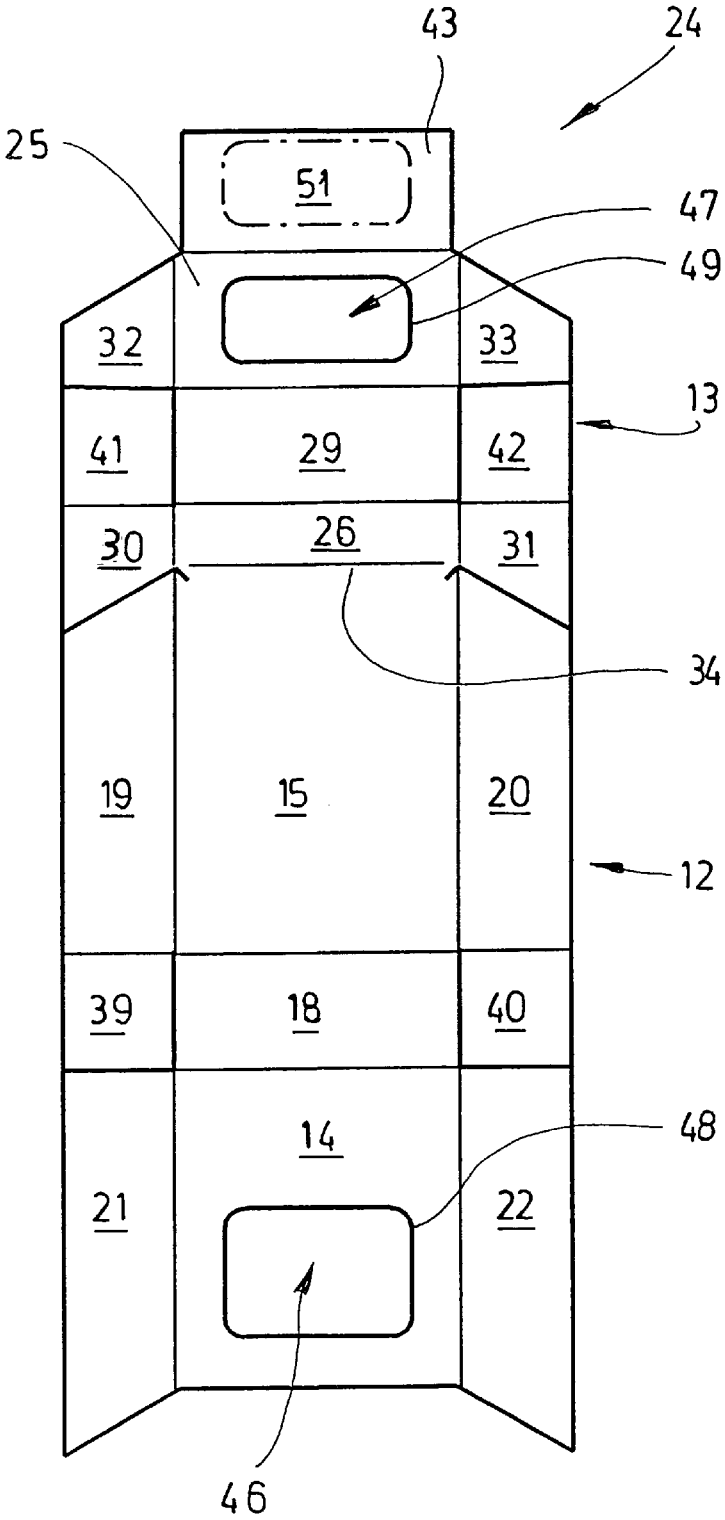
Figure 4:
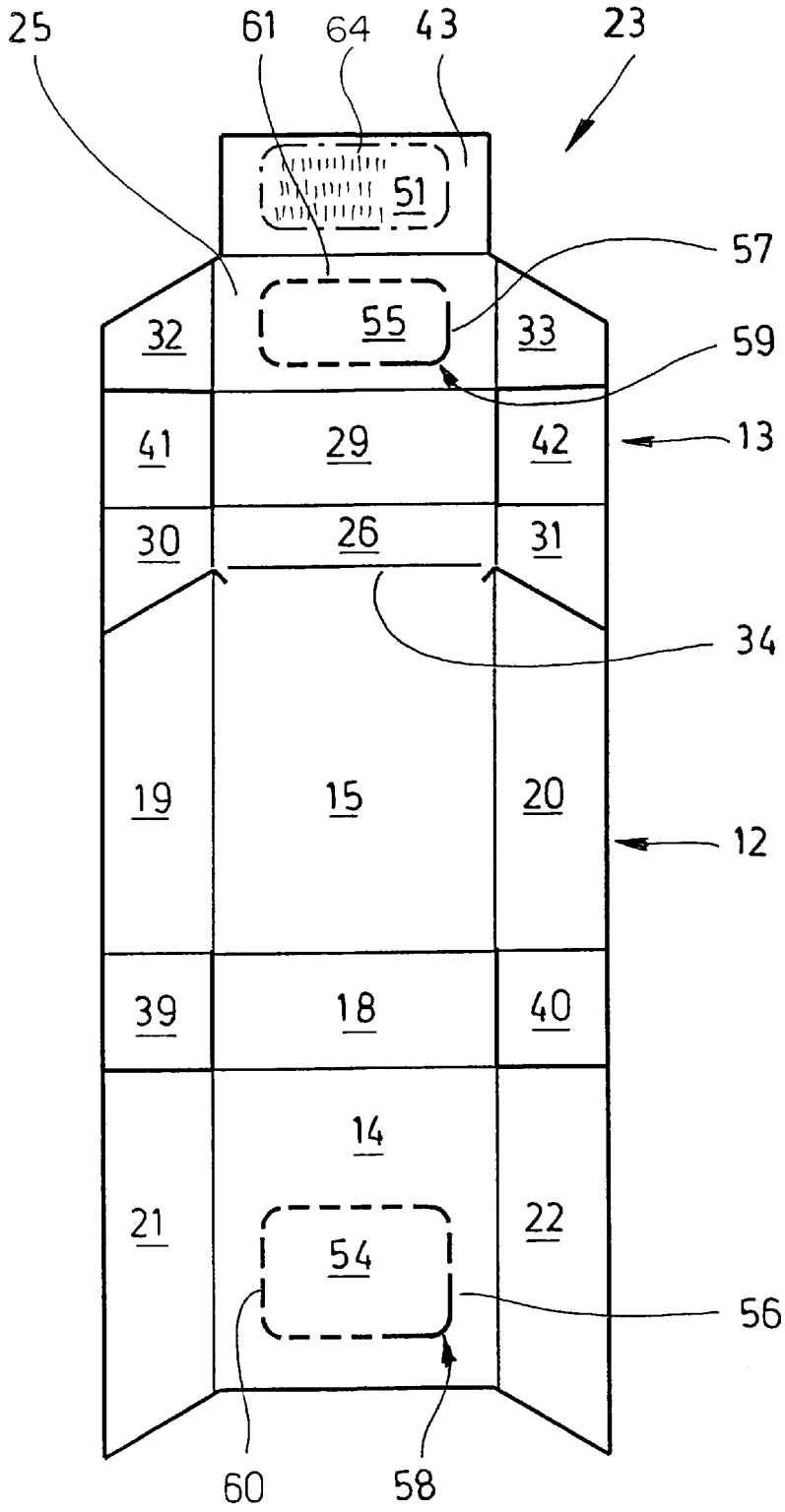
Figure 5:
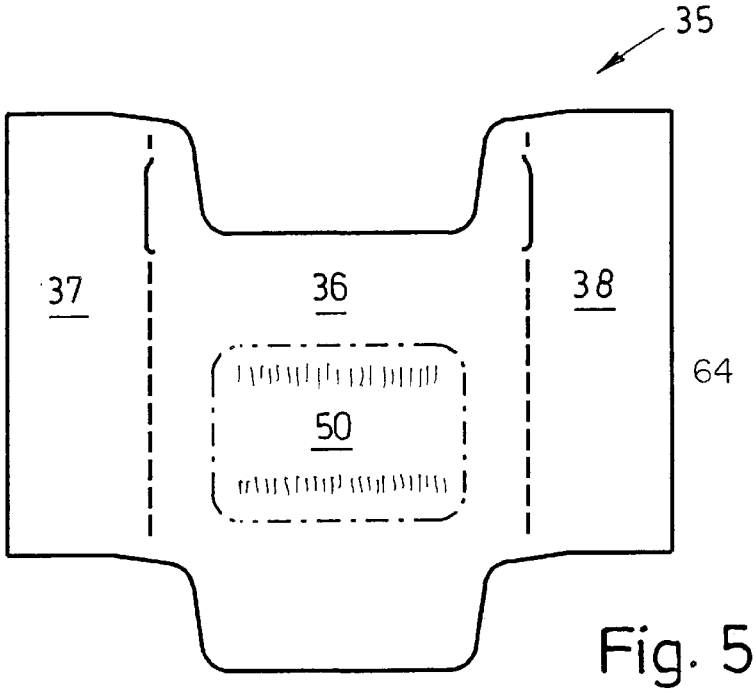
Figure 6:
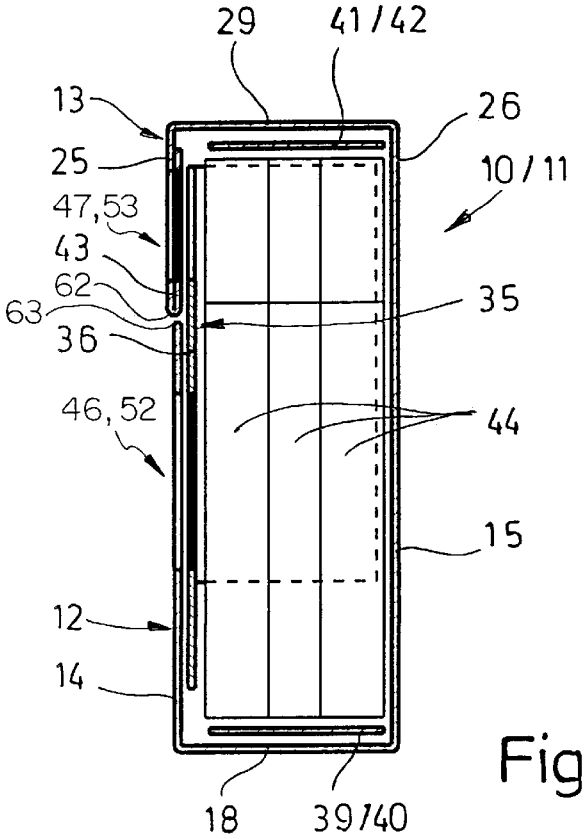

Preferred developments arise from the secondary claims and the description. Embodiments of the invention, given by way of example, are explained in greater detail with the aid of the drawings. These show:

FIG. 1 a hinge-lid packet according to a first embodiment of the invention, given by way of example, in perspective side view, FIG. 2 a hinge-lid packet according to a second embodiment of the invention, given by way of example, in a view analogous to FIG. 1, FIG. 3 a spread-out blank for the hinge-lid packet according to FIG. 1 in plan view, FIG. 4 a spread-out blank for the hinge-lid packet according to FIG. 2 in a view analogous to FIG. 3, FIG. 5 a spread-out blank for a collar for the hinge-lid packets according to FIGS. 1 and 2, in plan view, and FIG. 6 a cross-section through the hinge-lid packets according to FIGS. 1 and 2.

The embodiments represented here show hinge-lid packets for cigarettes. A group of cigarettes is surrounded as the packet contents by an inner wrapping made of paper or tin foil and thus forms a block of cigarettes. Since the hinge-lid packets have a largely identical structure, the same reference numbers are used below for the same elements.

The hinge-lid packets 10, 11 consist in each case of a packet portion 12 and a lid 13. The packet portions 12 comprise a front wall 14, rear wall 15, side walls 16, 17 and a base wall 18. The side walls 16, 17 are in each case formed from inner side flaps 19, 20 and outer side flaps 21, 22 of a one-piece blank 23 or 24 to form the packet portion 12 and lid 13 of the hinge-lid packet 10 or 11.

The lids 13 consist in each case of lid front wall 25, lid rear wall 26, lid side walls 27, 28 and a lid upper wall 29. The lid side walls 27, 28 are, just like the side walls 16, 17, formed by overlapping inner lid side flaps 30, 31 as well as outer lid side flaps 32, 33.

The respective lids 13 are hinged in the region of the lid rear wall 26 to the rear wall 15 of the packet portion 12 in each case via a hinge line 34.

In the packet portion 12 of the hinge-lid packets 10, 11, there sits in each case a collar 35 with collar front wall 36 and collar side walls 37, 38. The collar front wall 36 is connected to the front wall 14 of the packet portion 12 especially by gluing. The collar side walls 37, 38 are adjacent to the inner side of the side walls 16, 17 or the inner side flaps 19, 20 and are likewise connected to same by gluing.

Furthermore, corner flaps are of importance for the hinge-lid packets 10, 11. These are base corner flaps 39, 40 on the one hand and lid corner flaps 41, 42 on the other hand. The base corner flaps 39, 40 are connected to the adjacent side flaps 19, 20 lying on the inside, and the lid corner flaps 41, 42 to the lid side flaps 30, 31 lying on the inside.

In addition, a lid inner flap 43, which adjoins the lid front wall 25, forms in each case part of the hinge-lid packets 10, 11 or blanks 23, 24. When the hinge-lid packet 10, 11 is completely folded, the lid inner flap 43 is folded round against an inner side of the lid front wall 25. This complete folding causes the lid 13 and the packet portion 12, of both hinge-lid packets 10, 11, to come together to close the hinge-lid packet, with the lid and packet portion contacting along the closing edges 62 and 63, as shown in FIGS. 1 and 2.

FIG. 6 shows the cigarettes 44 received by the hinge-lid packets 10, 11. The block 45 formed by the cigarettes 44 is indicated in FIGS. 1 and 2 by dot-dash lines.

The special characteristic of the hinge-lid packet 10 according to FIG. 1 consists in the fact that it has recesses 46, 47 in the region of a wall of the packet portion 11, namely the front wall 14, on the one hand, and in the region of a wall of the lid 13, namely the lid front wall 25, on the other hand. The recesses 46, 47 of the hinge-lid packet 10 are stamped out of front wall 14 and lid front wall 25. Continuous stamping lines 48, 49 accordingly delimit the recesses 46, 47 from front wall 14 and lid front wall 25.

The recesses 46, 47 of the hinge-lid packet 10 according to FIG. 1 are open towards the outside and closed on the side pointing towards the block of cigarettes 45. In the embodiment shown here, the recess 46 in the region of the front wall 14 on the side pointing towards the block of cigarettes 45 is closed by a region of the collar 35, namely the collar front wall 36. The recess 47 in the region of the lid front wall 25, on the other hand, is closed by a region of the lid 13, namely of the lid inner flap 43, on the side pointing towards the block of cigarettes 45.

In regions 50 or 51, in which the collar front wall 36 or lid inner flap 43 overlaps the recesses 46 or 47, said collar front wall 36 or lid inner flap 43 serves as a carrier for an imprint 64. Regions 50, 51 of collar front wall 36 and lid inner flap 43 are delimited by dot-dash lines in FIGS. 3, 5.

The imprint in regions 50, 51 of collar front wall 36 and lid inner flap 43 is for example, a coupon composed of words and/or pictures. This can be a coupon, an entitlement voucher for participating in competitions, prize draws or the like. To this end, the collar 35 or collar front wall 36 must be printed on its front side. The lid inner flap 43, on the other hand, has to be printed on its rear side. This follows from the circumstance that, on the completely folded hinge-lid packets, the lid inner flap comes into contact with the lid front wall 25 by being folded round.

On the embodiment shown here, recess 46 is formed with a comparatively large surface in the region of the front wall 14 of the packet portion 12. As a result of this, the collar 35 accordingly has a greater depth than on traditional hinge-lid packets. In the embodiment shown here, the collar 35, namely its front wall 36, is extended almost into the region of the base wall 18. Moreover, the lid inner flap 43 extends over the full height of the lid front wall 36.

Hinge-lid packet 11 according to FIG. 2 likewise has recesses in the region of the packet portion 12 and lid 13. A first recess 52 is associated with the front wall 14 of the packet portion 12, a second recess 53 with the front wall of the lid 13. By contrast with hinge-lid packet 10 according to FIG. 1, the recesses 52, 53 of hinge-lid packet 11, however, are closed towards the outside. A covering 54, 55 which is detachable from the front wall 14 or from the lid front wall 25 serves this purpose in each case. The coverings 54 or 55 are portions of the front wall 14 or lid front wall 25. The coverings 54, 55 can be grasped and detached by the user via a holding tab 58, 59 delimited by continuous severance cuts 56, 57. To this end, the coverings 54, 55 of front wall 14 on the one hand, and lid front wall 25 on the other hand are delimited elsewhere by perforation lines 60, 61. The recesses 52, 53 in the region of the packet portion 12 or lid 13, are accordingly only revealed by detaching the coverings 54, 55.

Recesses 52, 53 of hinge-lid packet 11 are, just like recesses 46, 47 of hinge-lid packet 10, closed on the side pointing towards the block of cigarettes 45. This purpose is served by region 50 of the collar front wall 36 on the one hand, and by region 51 of the lid inner flap 43. For the details of this, reference can be made to the above explanations.

Coverings 54, 55 of hinge-lid packet 11 can serve as carriers for an additional imprint both on their front side and on their rear side. Thus, for example, a coupon or a lottery ticket number can be printed on the side of the coverings 54, 55 pointing towards the block of cigarettes 45. Only when the consumer has detached the covering 54, 55 does the imprint become visible to him.

As a variation on the embodiments shown in the drawings, it is furthermore possible to arrange additional recesses in the region of the side walls 16, 17 of the hinge-lid packet 10, 11. In this case, these recesses are associated with the outer side flaps 21, 22 or lid side flaps 32, 33. The inner side flaps 19, 20 or inner lid side flaps 30, 31 serve in this case to close the recesses on the side pointing towards the block of cigarettes 45 and as a carrier for an imprint.

FIGS. 3, 4 show the blanks 23, 24 for the manufacture of hinge-lid packets 10, 11. The blanks 23, 24 are of overall long stretched-out design. The walls of packet portion 12 and of lid 10 of hinge-lid packets 10, 11 are configured succeeding one another as on a blank for a traditional hinge-lid packet. Accordingly, in the longitudinal direction of the blanks 23, 24, front wall 14, base wall 18, rear wall 15, lid rear wall 26, lid upper wall 29 and lid front wall 25 are disposed in succession and defined by fold lines. The side flaps 19 . . . 22 or lid side flaps 30 . . . 33 are arranged on both sides of the front wall 14 and rear wall 15 or lid rear wall 26 and lid front wall 25 to form the side walls 16, 17 or lid side walls 27, 28. The base corner flaps 39, 40 or lid corner flaps 41, 42 adjoin the base wall 18 or lid upper wall 29 on both sides.

The blanks 23, 24 are detached from a continuous web of material. In this process, the recesses 47, 48 of front wall 14 and lid front wall 25 of blank 24 for manufacturing the hinge-lid packet 10 are also formed. To this end, stamping lines 48, 49 are introduced into blank 24. On blank 23, perforation lines 60, 61 are introduced into front wall 14 and lid front wall 25 to delimit coverings 54, 55. After the individual blanks have been stamped out and the stamping lines 48, 49 or perforation lines 60, 61 introduced into blanks 23 or 24, the printing is applied to the blanks 23, 24. To this end, lid flap 43 is printed on in region 51 on the rear side. The coverings 54, 55 of blank 23 can be printed on both on their front side and on their rear side.

According to the embodiment shown here, the collar 35 is manufactured from a separate blank. As a variation on the embodiment shown here, however, it is possible for the hinge-lid packet to be formed from a one-piece blank for packet portion 12, lid 13 and collar 35.

What is claimed is:

1. A hinge-lid packet for cigarettes, made of thin cardboard, comprising:

a packet portion, for receiving a block of cigarettes, a lid, hinged to a rear wall of the packet portion and a collar, connected to the packet portion and having a collar front wall and collar side walls, and wherein an opening is arranged in a region of a lid front wall of the lid, and the opening is completely covered by a lid inner flap at an inner side of the lid front wall, and the lid inner flap is connected to the lid front wall in a region of a lower closing edge of the lid inner flap, and the lid inner flap extends from said closing edge, past the opening, up to a point almost touching a lid upper wall.

2. The hinge-lid packet for cigarettes according to claim 1, wherein another opening (46, 52) is arranged in a region of a front wall (14) of the packet portion (12) and extends at a distance from an upper closing edge (62) of the front wall (14) said lower closing edge (63) of the lid inner flap (43) abuts said upper closing edge (62) when the lid (13) is in a closed position, and said another opening (46, 52) is completely covered on the inside of the packet portion by the collar front wall (36) of the collar (35).

3. Hinge-lid pack according to claim 1, wherein the opening is closed by a covering which may be detached from the packet by grasping a holding tab, and that said covering is delimited by a perforation line which is delimited by a continuous severance cut.

4. Hinge-lid pack according to claim 3, characterized in that the covering has printing on at least one side of said covering.

5. Hinge-lid pack according to claim 1, wherein a part of the packet beneath the opening has been imprinted on an outer side of the part of the packet facing the opening.

6. A hinge-lid box according to claim 1, wherein the opening (53) is closed by a covering (55) which is delimited on all sides by a perforation line (61), and which with the aid of the perforation line (61) can be detached from the lid front wall (25).

* * * * *